US009038900B2

(12) United States Patent
Galanti et al.

(10) Patent No.: US 9,038,900 B2
(45) Date of Patent: May 26, 2015

(54) ELECTRONIC APPARATUS FOR DETERMINING THE ATTITUDE OF A WEAPON AND OPERATING METHOD THEREOF

(75) Inventors: Marco Galanti, Rufina (IT); Luca Mattonai, Pontedera (IT); Nicola Santini, Quarrata (IT)

(73) Assignee: SELEX GALILEO S.P.A., Campi Bisenzio (IT)

( * ) Notice: Subject to any disclaimer, the term of this patent is extended or adjusted under 35 U.S.C. 154(b) by 187 days.

(21) Appl. No.: 13/640,840

(22) PCT Filed: Apr. 12, 2011

(86) PCT No.: PCT/IB2011/000818

§ 371 (c)(1),
(2), (4) Date: Dec. 20, 2012

(87) PCT Pub. No.: WO2011/128762

PCT Pub. Date: Oct. 20, 2011

(65) Prior Publication Data

US 2013/0091754 A1 Apr. 18, 2013

(30) Foreign Application Priority Data

Apr. 12, 2010 (IT) ..... TV2010A0060

(51) Int. Cl.

| | |
|---|---|
| ***G06F 19/00*** | (2011.01) |
| ***F41G 1/48*** | (2006.01) |
| ***F41G 1/44*** | (2006.01) |
| ***F41G 3/14*** | (2006.01) |

(52) U.S. Cl.
CPC .. *F41G 1/48* (2013.01); *F41G 1/44* (2013.01); *F41G 3/14* (2013.01)

(58) Field of Classification Search
USPC ..... 235/400, 404, 407, 417
IPC ..... F41J 5/06; F41G 9/02,3/06; G05B 19/00; G06G 7/80, 7/32
See application file for complete search history.

(56) References Cited

U.S. PATENT DOCUMENTS

| | | | |
|---|---|---|---|
| 6,636,826 | B1 | 10/2003 | Abe et al. |
| 7,296,358 | B1 | 11/2007 | Murphy et al. |

FOREIGN PATENT DOCUMENTS

| | | | |
|---|---|---|---|
| EP | 0785406 | A2 | 7/1997 |
| EP | 1762811 | A1 | 3/2007 |

OTHER PUBLICATIONS

Vaganay J et al: "Mobile robot attitude estimation by fusion of inertial data", Proceedings of the International Conference on Robotics and Automation Atlanta, May 2-6, 1993; Los Alamitos, IEEE Comp.; vol. Conf. 10, pp. 277-282.

International Search Report, for application No. PCT/IB2011/000818, European Patent Office, Sep. 8, 2011, Rijswijk, 4 pages.

*Primary Examiner* — Karl D Frech
(74) *Attorney, Agent, or Firm* — Kevin D. Jablonski; Lane Powell PC

(57) ABSTRACT

An embodiment of an apparatus for determining the attitude angles of a weapon includes a number of accelerometers for measuring the components of the acceleration of the weapon along the axes of a first reference system integral with weapon; a number of gyroscopes configured in such a way to measure the components of the angular speed of the weapon along the axes of the reference body; and a processing unit configured to compute a number of actual attitude angles of the weapon under dynamic conditions based on the components of the angular speed; determine a number of static attitude angles of the weapon under static conditions of the weapon based on the components of the acceleration; and correct the components of angular speed according to static attitude angles and to the actual attitude angles.

13 Claims, 4 Drawing Sheets

ELECTRONIC APPARATUS FOR DETERMINING THE ATTITUDE OF A WEAPON AND OPERATING METHOD THEREOF

PRIORITY CLAIM

The present application is a national phase application filed pursuant to 35 USC §371 of International Patent Application Serial No. PCT/IB2011/000818, filed Apr. 12, 2011; which further claims the benefit of Italian Patent Application Serial No. TV2010A000060 filed Apr. 12, 2010; all of the foregoing applications are incorporated herein by reference in their entireties.

TECHNICAL FIELD

An embodiment relates to an electronic apparatus for determining the attitude of a weapon and to the operating method thereof.

In particular, an embodiment relates to an electronic apparatus couplable to a weapon, in particular to a grenade launcher, for determining, instant by instant, the Pitch, Roll and Heading angles of the weapon; to which the following disclosure will explicitly refer without however losing in generality.

BACKGROUND

The need is known in the field of portable weapons, and in particular of grenade launchers, to be able to determine the instantaneous attitude of the weapon so as to employ such information in ballistic computing programs adapted to provide the operator shouldering the weapon indications in real time relating to the shooting attitude to be given to the weapon with the purpose of hitting a target.

U.S. Pat. No. 7,296,358 B1, which is incorporated by reference, discloses an electronic vertical angle sensing and indicating device for use on aiming systems that are provided for bow sights and for other aiming sights for projectile launchers. Improved vertical level measurement and display minimizes the left-right drift of a projectile by sensing and indicating to the user when the projectile launcher is tilted slightly prior to release of the projectile.

Document VAGANAY J ET having title "mobile robot attitude estimation by fusion of inertial data" (Proceedings of the international conference on robotics an automation—ATLANTA, May 2-6 1993), which is incorporated by reference, discloses an attitude estimation system based on inertial measurements for a mobile robot wherein five low-cost inertial sensors are used.

US636826 B1, which is incorporated by reference, discloses an orientation angle detector using gyroscopes for detecting X-, Y- and Z-angular velocities which are time-integrated to produce pitch, roll and yaw angles (gamma, beta, alpha) of the orientation. Two accelerometers are used to obtain tentative pitch and roll angles in order to correct the pitch and roll angles, and two terrestrial magnetometers are used to obtain a tentative yaw angle so as to correct the yaw angle. When the tentative pitch, roll and yaw angles are defined accurate (50), the integrated pitch, roll and yaw angles are corrected (60) by the tentative pitch, roll and yaw angles.

SUMMARY

For this purpose, several efforts have been made by weapons manufacturers to develop an electronic apparatus of the above-described type, which is affordable to make, has an overall reduced weight and volume so as to not significantly affect the manoeuvrability of the weapon and, simultaneously, is fast and accurate in providing the indication on the attitude.

Thus, an embodiment is a particularly light and affordable electronic apparatus which is capable of determining, in real time, i.e., with extreme rapidity, and with high accuracy, the attitude of the weapon on which the apparatus itself is installed.

According to the present invention, an electronic apparatus is made for determining the attitude of a weapon.

According to an embodiment, a method is also provided for determining the instantaneous attitude of a weapon.

According to an embodiment, a computer product loadable onto the memory of a computer is lastly provided for determining, when implemented by the latter, the attitude of a weapon.

BRIEF DESCRIPTION OF THE DRAWINGS

One or more embodiments will now be described with reference to the accompanying drawings, which illustrate one or more non-limiting examples thereof, in which.

DETAILED DESCRIPTION

An embodiment is generally based on the idea of making an electronic apparatus which is capable of:

- determining the components of the acceleration of the weapon along the axes of a reference system coinciding with certain axes of the weapon, in such a way that the movement of the weapon in space determines the same movement of the reference system;
- determining the components of the angular speed of the weapon along the axes of the reference system;
- determining the attitude angles of the weapon, indicated below with static attitude angles, based on the components of the acceleration filtered through a low-pass filter; the static attitude angles being determined under a condition of static nature during which the weapon is immobile or is moved with a negligible speed, i.e., less than a pre-established minimum threshold;
- determining a number of actual attitude angles of the weapon by integrating the angular speed components over time;
- determining some correction factors according to the difference between the actual attitude angles and the static attitude angles;
- correcting the components of the angular speed of the weapon based on the corresponding correction factors.

As it will become more apparent below, the idea mentioned above on one hand employs the components of the acceleration filtered in low frequency to determine the attitude angles of the weapon under the static condition in such a way as to be able to determine an initial attitude angle, for example in a settings step, and on the other hand, to correct the errors introduced by the electronic measuring devices in the speed components.

To better comprehend an embodiment, first of all there is a need to define a mathematical formalism which describes the three-dimensional reference systems employed in computing the attitude angles of the weapon.

Figure 4:
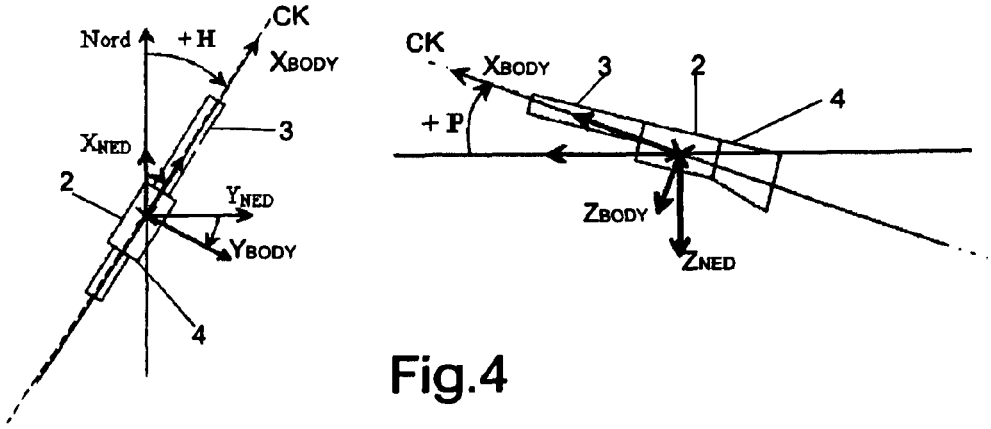
FIG. 4 shows a first reference system restrained to the weapon on which the electronic apparatus shown in FIG. 1 is installed according to an embodiment.
Figure 6:
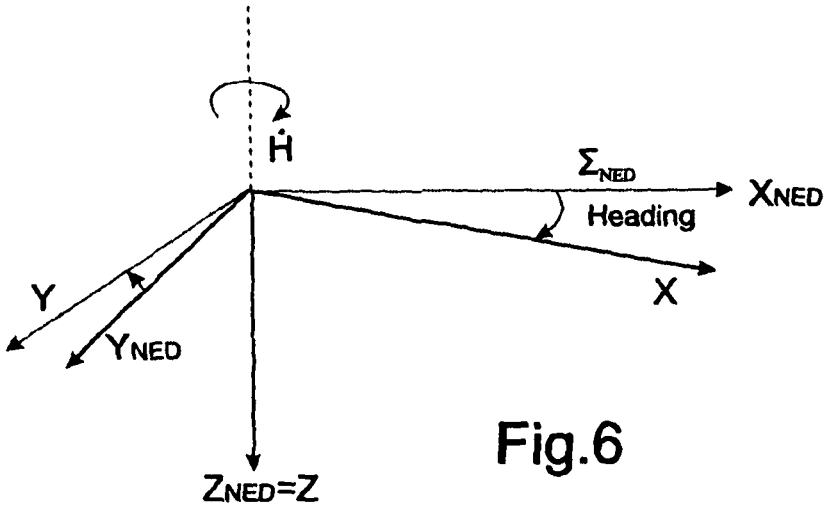
FIGS. 6, 7 and 8 diagrammatically show some reference systems employed by the electronic apparatus for determining the attitude of the weapon according to an embodiment.
Figure 7:
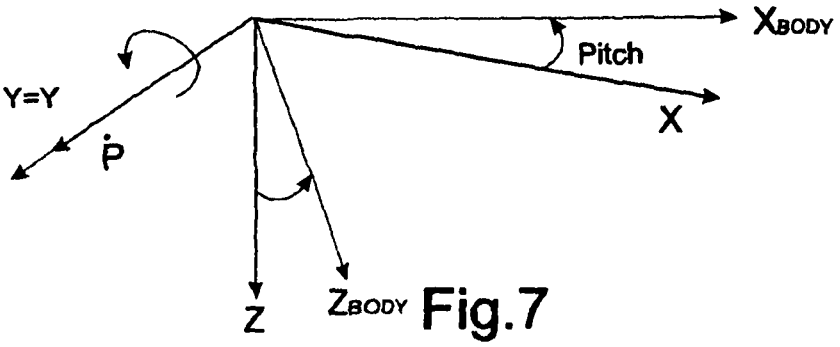

In particular, reference will be made below to two different three-dimensional reference systems, the first of which is a movable reference system associated with the weapon (shown in FIGS. 4 and 8), while a second reference system is fixed and is associated with the four cardinal points of the earth (shown in FIGS. 4 and 6).

Figure 8:
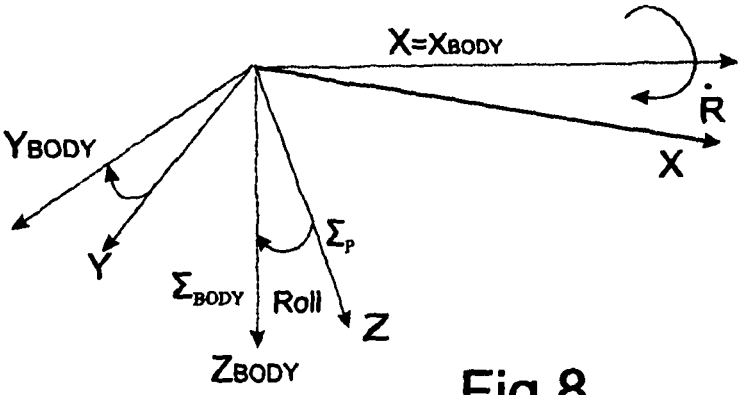

In this case, with reference to the example shown in FIGS. 4 and 8, the first reference system indicated below with BODY reference system $\Sigma_{BODY}$ is associated with the weapon, and has three reference axes orthogonal to each other, wherein a first axis $X_{Body}$ is coaxial to the longitudinal axis CK of the weapon; a second axis $Y_{Body}$ is arranged according to a direction perpendicular to the right side of the weapon and to the first axis $X_{Body}$; and a third axis $Z_{Body}$ is oriented according to direction perpendicular to the bottom side of the weapon and to the lying plane of the first $X_{Body}$ and second axis $Y_{Body}$.

With regards to the second reference system, it is indicated below with NED system $\Sigma_{NED}$ (shown in FIGS. 4 and 6) and has a first axis $X_{NED}$ oriented towards terrestrial geographical north; a second axis $Y_{NED}$ oriented towards terrestrial geographical east; and a third axis $Z_{NED}$ oriented towards the plane, that is the ground, i.e., the ground surface in such a way to be orthogonal thereto and to the lying plane of the first $X_{NED}$ and second axis $Y_{NED}$.

In particular, the components of the angular speed and the components of the acceleration will be expressed below by means of the vectors based on the BODY reference system $\Sigma_{BODY}$; while the attitude angles Pitch, Roll and Heading will be determined below with respect to the NED reference system $\Sigma_{NED}$.

Figure 1:
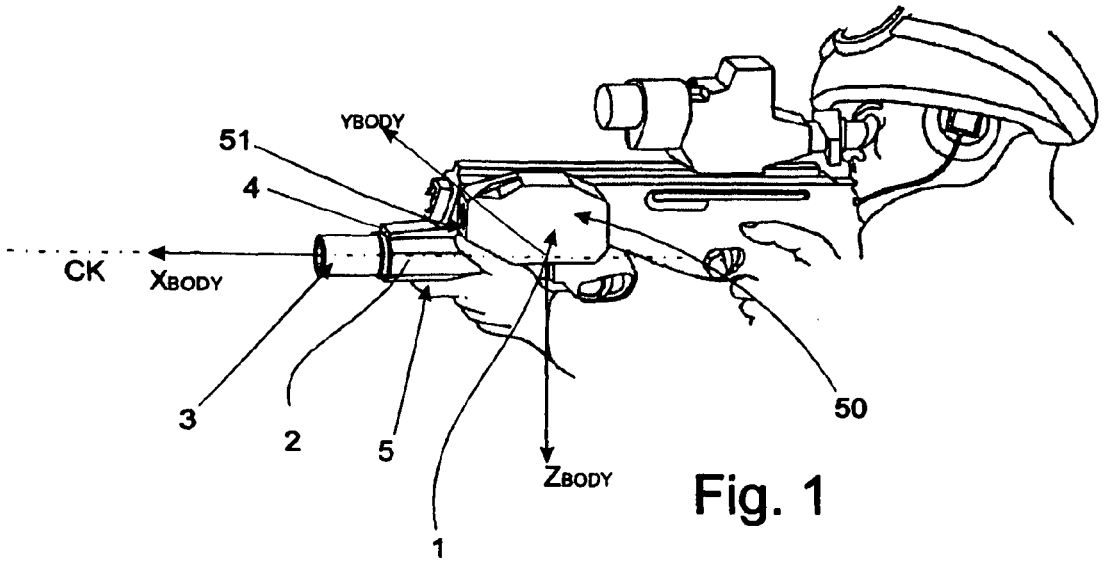
FIG. 1 diagrammatically shows an electronic apparatus for determining the attitude of a weapon, made according to an embodiment.

With reference to FIG. 1, numeral 1 indicates as a whole an electronic apparatus, configured to determine the attitude angles of Pitch, Roll and Heading of a portable weapon 2, according to an embodiment.

In the example illustrated in FIG. 1, weapon 1 includes a barrel 3, which extends along a longitudinal axis CK, and a barrel support frame 4 provided with a grip 5 adapted to allow the weapon to be grasped by the operator and to conveniently orientate the barrel 3 in the space to hit a target.

With regards to the electronic apparatus 1, it is coupled with weapon 2 and includes an inertial electronic platform 6, configured to provide the outbound components Ax, Ay, Az of the acceleration and the components Gx, Gy and Gz of the angular speed of weapon 2 determined with respect to the BODY reference system $\Sigma_{BODY}$.

In this case, the inertial electronic platform 6 is configured in such a way to determine the three components Ax, Ay, Az of the acceleration and the three components of the angular speed Gx, Gy and Gz of weapon 2 in the respective reference axes $X_{BODY}$, $Y_{BODY}$ and $Z_{BODY}$ of the BODY reference system $\Sigma_{BODY}$.

In the example shown in FIGS. 1 and 4, the reference axis $X_{BODY}$ is arranged coaxially to the longitudinal axis CK of barrel 3 of the weapon; the reference axis $Y_{BODY}$ is oriented towards the right side of the support frame 4 of weapon 2, in the condition of gripping the weapon, in such a way as to be orthogonal to the first reference $X_{BODY}$; while the reference axis $Z_{BODY}$ is oriented towards the space below the frame of weapon 2, in the condition of gripping the weapon, and is perpendicular to the reference axis $Y_{BODY}$.

Figure 2:
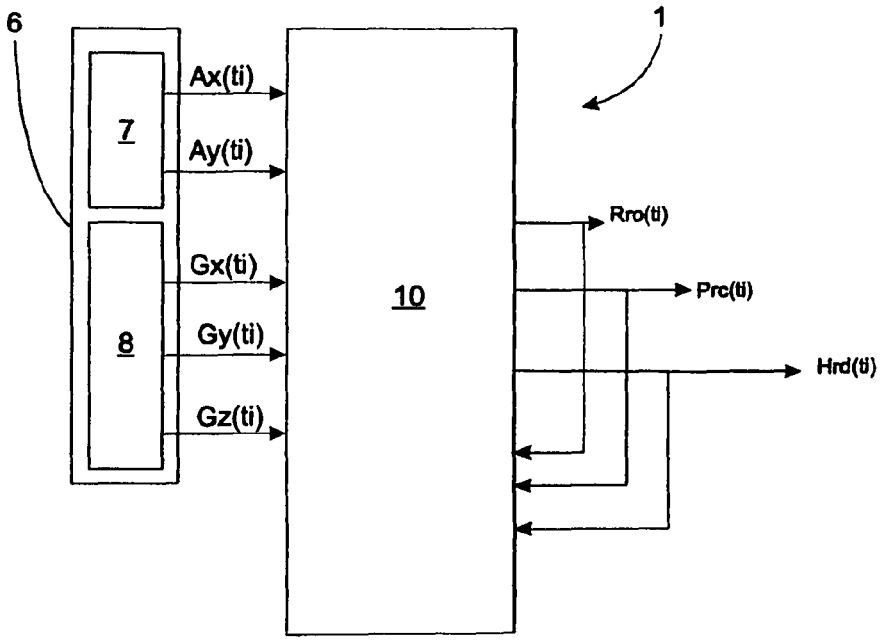
FIG. 2 shows a block diagram of the electronic apparatus shown in FIG. 1 according to an embodiment.
Figure 3:
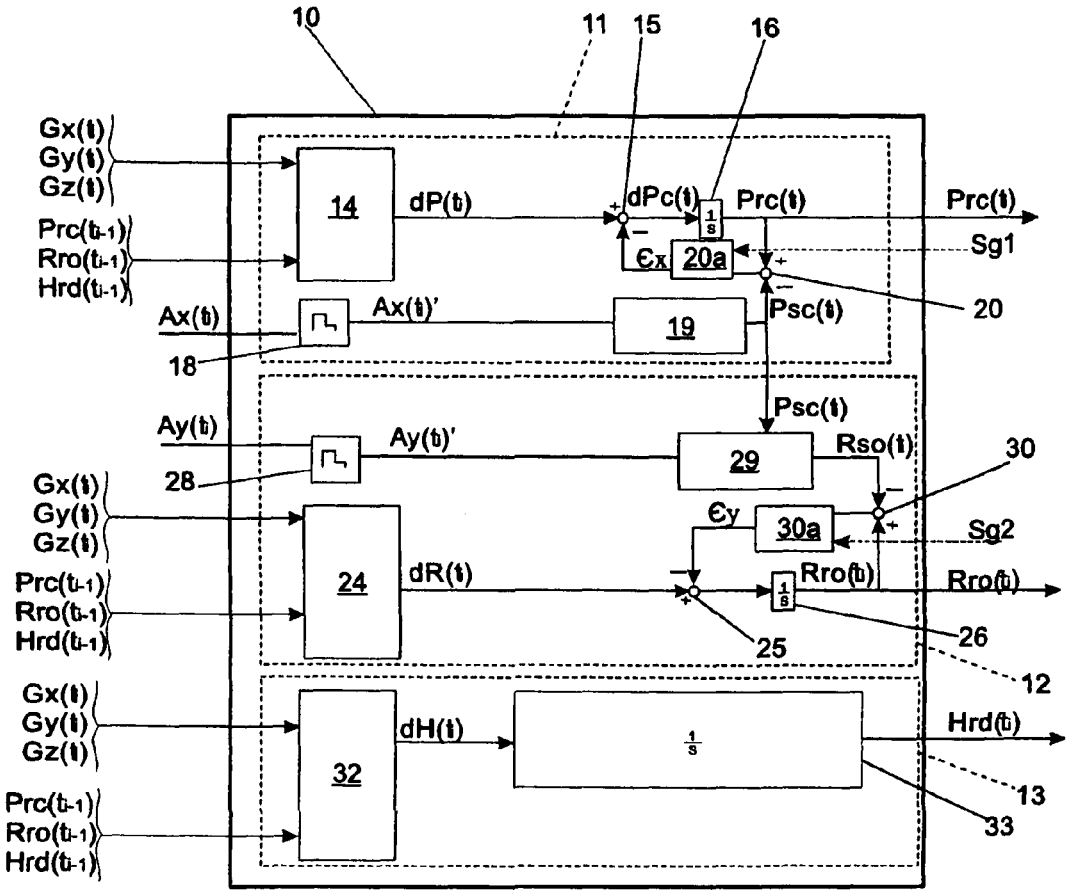
FIG. 3 is a block diagram of the processing unit in the electronic apparatus shown in FIG. 1.

With reference to the example shown in FIG. 2, the inertial electronic platform 6 conveniently includes one or more accelerometers 7, for example a biaxial accelerometer or two monoaxial accelerometers, having two measuring axes arranged along axes $X_{BODY}$ and $Y_{BODY}$ of the BODY reference system $\Sigma_{BODY}$.

The inertial electronic platform 6 also includes one or more gyroscopes 8, for example, a triaxial gyroscope, globally having three measuring axes arranged parallel to the axes $X_{BODY}$, $Y_{BODY}$ and $Z_{BODY}$ of the BODY reference system $\Sigma_{BODY}$.

Moreover, the electronic apparatus 2 includes a processing unit 10, which receives the inbound acceleration components $A_x$, $A_y$, $A_z$ and the components of the angular speed $G_x$, $G_y$ and $G_z$ measured by the inertial electronic platform 6, and processes them according to a computing method, described in detail below, which provides the real/actual outbound attitude angles of weapon 2, i.e., the determined Pitch angle Prc, the Roll angle Rrc and the Heading angle Hrc, instant by instant, with respect to the NED reference system $\Sigma_{NED}$.

In particular, with reference to FIG. 2, the processing unit 10 includes three computing modules.

In particular the first computing module 11 receives, at all times $t_i$, the inbound acceleration component $A_x(t_i)$, the components $Gx(t_i)$, $Gy(t_i)$ and $Gz(t_i)$ of the angular speed and the actual attitude angles, that is the angles of Pitch $Prc(t_{i-1})$, Roll $Rro(t_{i-1})$ and Heading $Hrd(t_{i-1})$ computed at a computing time $t_{i-1}$ preceding the current computing time $t_i$, and provides the actual outbound Pitch $Prc(t_{i-1})$ angle.

A second computing module 12 is configured to receive, at all times $t_i$, the inbound acceleration component $A_y(t_i)$, the components $Gx(t_i)$, $Gy(t_i)$ and $Gz(t_i)$ of the angular speed and the actual attitude angles, that is the angles of Pitch $Prc(t_{i-1})$, Roll $Rro(t_{i-1})$ and Heading $Hrd(t_{i-1})$ computed at a computing time $t_o$ preceding the current computing time $t_i$, and provides the actual outbound Roll $Rro(t_i)$ angle.

Instead, with regards to the third computing module 13, it receives, at all times $t_i$, the inbound acceleration component $A_z(t_i)$, the components $Gx(t_i)$, $Gy(t_i)$ and $Gz(t_i)$ of the angular speed and the actual attitude angles, that is the angles of Pitch $Prc(t_{i-1})$, Roll $Rro(t_{i-1})$ and Heading $Hrd(t_{i-1})$ computed at a computing time $t_o$ preceding the current computing time $t_i$, and provides the actual outbound Heading $Hrd(t_i)$ angle.

In particular, the first computing module 11 includes a first computing block 14, which is configured to receive, at the time $t_i$, the inbound components $Gx(t_i)$, $Gy(t_i)$ and $Gz(t_i)$ of the angular speed and the actual angles of Pitch $Prc(t_{i-1})$, Roll $Rro(t_{i-1})$ and Heading $Hrd(t_{i-1})$ determined at the preceding computing time $t_{i-1}$, and provides an outbound partition or Pitch differential $dP(t_i)$, which is computed using the following relation:

$$dP(t)=Gy(t)*\cos(Rro(t_{i-1}))-Gz(t_i)*\sin(Rro(t_{i-1})). \quad \text{A)}$$

The first computing module 11 also includes a summing node 15, which receives the inbound Pitch differential $dP(t_i)$ and a correction factor $\epsilon_X$ (whose computation will be described in detail below), and provides the corrected outbound Pitch differential $dPc(t_i)$. In this case, the summing node 15 computes the corrected Pitch differential $dPc(t_i)$ by subtracting the correction factor $\epsilon_X$ from the Pitch differential $dP(t_i)$.

The first computing module 11 also includes an integrating block 16, which integrates the corrected pitch differential $dPc(t_i)$ over time so as to determine and provide the actual outbound Pitch angle $Prc(t_i)$.

The first computing module 11 is also equipped with a filtering block 18, for example, including a low-pass filter, which receives the inbound acceleration component $Ax(t_i)$ and provides the outbound acceleration component $Ax(t_i)'$ filtered in low frequency.

The first computing module 11 also includes an operating block 19, which receives the inbound filtered acceleration component $Ax(t_i)'$ and provides the static outbound Pitch angle $Psc(t_i)$. In this case, the operating block 19 computes the static Pitch angle $Psc(t_i)$ by implementing the following mathematical relation:

$$Psc(ti)=\arcsin(Ax(t_i)'). \quad \text{B)}$$

The first computing module 11 also includes a summing node 20, which receives the inbound actual Pitch angle $Prc(t_{i-1})$ and the static Pitch angle $Psc(t_i)$ and provides the outbound correction factor Ex.

In particular, the summing node 20 computes the correction factor Ex by subtracting the static Pitch angle $Psc(t_i)$ from the actual Pitch angle $Prc(t_i)$.

The first computing module 11 may also, for example, include an amplifying module 20*a* capable of multiplying the correction factor Ex by a variable gain G1 based on an input signal Sg1.

With regards to the second computing module 12, it includes a first computing block 24, which is configured to receive, at the time $t_i$, the inbound components $Gx(t_i)$, $Gy(t_i)$ and $Gz(t_i)$ of the angular speed and the attitude angles Pitch $Prc(t_{i-1})$, Roll $Rro(t_{i-1})$ and Heading $Hrd(t_{i-1})$ determined at the preceding time $t_{i-1}$, and which provides an outbound partition, that is a Roll differential $dR(t_i)$, which is computed using the following relation:

$$dR(t_i)=R1+R2; \text{ in which} \quad \text{C)}$$

$$R1=Gx(t_i)+Gy(t_i)*\sin(Rro(ti-1)*\tan(Prc(t_i)); \text{ and}$$

$$R2=Gz(t_i-1)*\cos(Rro(t_i-1))*\tan(Prc(t_i-1))$$

The second computing module 12 also includes a summing node 25, which receives the inbound Roll differential $dR(t_i)$ and a correction factor $\epsilon_Y$ (which is computed in the way described in detail below), and provides an outbound corrected Roll differential $dRc(t_i)$. In this case, the summing node 25 computes the corrected Roll differential $dRc(t_i)$ by subtracting the correction factor $\epsilon_Y$ from the Roll differential $dR(t_i)$.

The second computing module 12 also includes an integrating block 26 which integrates the partition, that is the corrected Roll differential $dRc(t_i)$ so as to provide the actual outbound Roll angle $Rro(t_i)$.

The second computing module 12 also includes a filtering block 28 in turn including a low-pass filter, which receives the inbound acceleration component $Ay(t_i)$ and provides the outbound acceleration component $Ay(t_i)'$ filtered in low frequency.

The second computing module 12 also includes an operating block 29, which receives the inbound filtered acceleration component $Ay(t_i)'$ and provides the static outbound Roll angle $Rso(t_i)$. In this case, the operating block 29 computes the static Roll angle $Rso(t_i)$ by implementing the following mathematical relation:

$$Rso(t_i)=\arcsin(Ay(t_i)')/\cos(Psc(t_i). \quad \text{D)}$$

The second computing module 12 also includes a summing node 30, which receives the inbound actual Roll angle $Rro(t_i-1)$ and the static Roll angle $Rso(t_i)$ and provides the outbound correction factor $\epsilon_Y$. In particular, the summing node 30 computes the correction factor $\epsilon_Y$ by subtracting the static Roll angle $Rso(t_i)$ from the actual Roll angle $Rro(t_i)$.

The second computing module 12 may also, for example, include an amplifying module 30*a* capable of multiplying the correction factor $\epsilon_Y$ by a variable gain G2 based on an input signal Sg2.

Lastly, with regards to the third computing module 13, it includes a computing block 32, which is configured to receive, at the time $t_i$, the inbound components $Gx(t_i)$, $Gy(t_i)$ and $Gz(t_i)$ of the angular speed and the actual attitude angles Pitch $Prc(t_i-1)$, Roll $Rro(t_i-1)$ and Heading $Hrd(t_i-1)$ determined at the preceding time $t_i-1$, and which provides an outbound partition or Heading differential $dH(t_i)$, which is computed using the following relation:

$$dH(t_i)=H1+H2; \text{ in which} \quad \text{E)}$$

$$H1=Gy(t_i)*\sin(Rro(t_i-1))/\cos(Prc(t_i-1));$$

$$H2=Gz*\cos(Rro(t_i-1)/\cos(Prc(t_i-1).$$

The third computing module 13 also includes an integrating block 33 configured to integrate the Heading differential $dH(t_i)$ over time so as to determine and provide the actual outbound Heading angle $Hrd(t_i)$.

Figure 5:
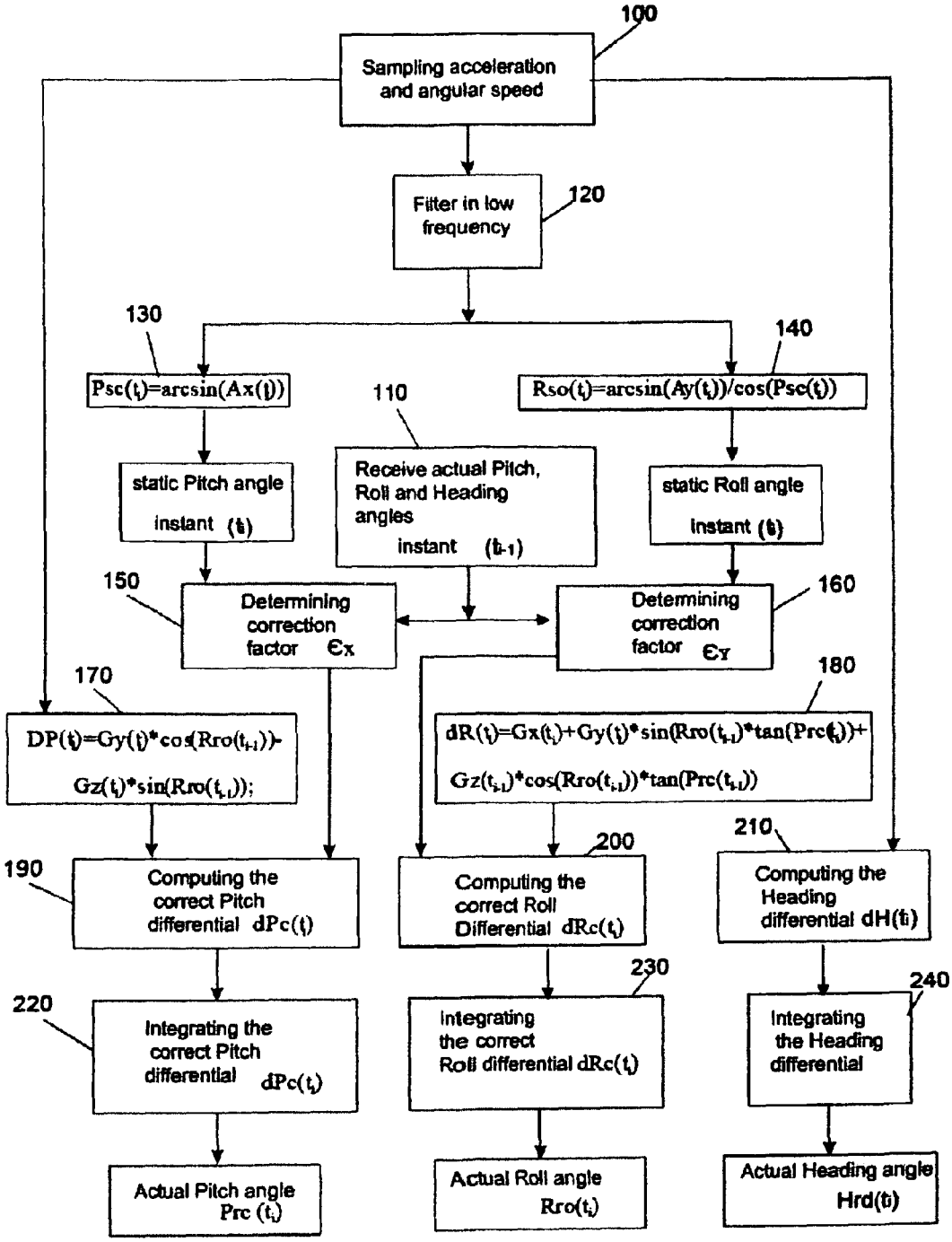
FIG. 5 is a flow diagram of the operations implemented by the electronic apparatus shown in FIG. 1 according to an embodiment.

With reference to FIG. 5, an embodiment of a method will be described below for determining the attitude angles of the weapon implemented from the first 11, from the second 12 and from the third computing module 13 of the processing unit 10.

For descriptive simplicity, the operating architecture will be described below of an operating cycle in a generic computing time $t_i$, as the processing unit 10 repeats the same steps over time, which characterize the operating cycle itself.

In particular, it is assumed that a computing cycle has been completed of the actual Pitch $Prc(t_i-1)$, Roll $Rro(t_i-1)$ and Heading $Hrd(t_i-1)$ angles at the computing time $t_i-1$, preceding to the current computing time $t_i$.

At the computing time $t_i$, the method provides implementing the following steps:

- sampling the acceleration components $AX(t_i)$, $AY(t_i)$, $AZ(t_i)$ and the components $Gx(t_i)$, $Gy(t_i)$, $Gz(t_i)$ of the angular speed measured by the inertial electronic platform 6 (block 100);
- receiving the actual angles of Pitch $Prc(t_i-1)$, Roll $Rro(t_i-1)$ and Heading $Hrd(t_i-1)$ determined in the cycle preceding the time $t_i-1$ to the current time $t_i$ (block 110);
- filtering the acceleration components $AX(t_i)$ and $AY(t_i)$ in low frequency (block 120);
- computing the static Pitch angle $Psc(t_i)$ by implementing the following mathematical relation: $Psc(t_i)=\arcsin(Ax(t))$ (block 130);
- computing the static Roll angle $Rso(t_i)$ by implementing the following mathematical relation: $Rso(t_i)=\arcsin(Ay(t_i))/\cos(Psc(t_i))$ (block 140);
- determining the correction factor $\epsilon x$ by computing the difference between the actual Pitch angle $Prc(t_i-1)$ computed at the time $t_o$ over the computing cycle preceding the current one, and the static Pitch angle $Psc(t_i)$ (block 150);
- determining the correction factor $\epsilon_Y$ by computing the difference between the actual Roll angle $Rro(t_{i-1})$ computed at the time $t_o$ over the computing cycle preceding the current one, and the static Roll angle $Rso(t_i)$ (block 160);

computing the Pitch differential $dP(t_i)$ (block 170) through the relation:

$$dP(t)=Gy(t_i)*\cos(Rro(t_i-1))-Gz(t_i)\sin(Rro(t_i-1));$$

computing the Roll differential $dR(t_i)$ (block 180) through the following relation:

$$dR(t)=Gx(t)+Gy(t_i)*\sin(Rro(t_{i-1})*\tan(Prc(t))+Gz(t_i-1)*\cos(Rro(t_{i-1}))*\tan(Prc(t_{i-1}))$$

computing the corrected Pitch differential $dPc(t_i)$ by subtracting the correction factor $\epsilon_X$ from the Pitch differential $dP(t_i)$ (block 190);

computing the corrected Roll differential $dRc(t_i)$ by subtracting the correction factor $\epsilon_Y$ from the Roll differential $dR(t_i)$ (block 200);

computing the Heading differential $dH(t_i)$ (block 210) through the following mathematical relation:

$$dH(t_i)=H1+H2;\text{ in which } H1=Gy(t_i)*\sin(Rro(t_{i-1}))/\cos(Prc(t_{i-1});$$

$$H2=Gz*\cos(Rro(t_{i-1})/\cos(Prc(t_{i-1});$$

integrating the corrected Pitch differential $dPc(t_i)$ over time so as to determine and provide the actual outbound Pitch angle $Prc(t_i)$ (block 220);

integrating the corrected Roll differential $dRc(t_i)$ so as to provide the actual outbound Roll angle $Rro(t_i)$ (block 230);

integrating the Heading differential $dH(t_i)$ over time so as to determine the actual Heading angle $H(t_i)$ (block 220).

From the above description, it is suitable to point out that the above-described mathematical relations A), B), C), D) and E) are obtainable based on the following mathematical-matrix considerations.

In particular, the absolute speed of the weapon is indicated hereinafter with $W_{BH}$. In this case, the letter W indicates that the type of magnitude under examination is an angular speed; the footnote$_B$ indicates that the angular speed in the BODY reference system $\Sigma_{BODY}$ of the weapon is involved, while$_H$ indicates that absolute speed is involved. A third footnote will also be used hereinafter which identifies the reference system with respect to which the magnitude under examination is expressed. Thus the absolute angular speed of the weapon may be expressed as the sum of three vectors, written in the three specified references:

$$W_{BH}=\begin{bmatrix}0\\0\\\dot{H}\end{bmatrix}_{\Sigma_{NED}}+\begin{bmatrix}0\\\dot{P}\\0\end{bmatrix}_{\Sigma_H}+\begin{bmatrix}\dot{R}\\0\\0\end{bmatrix}_{\Sigma_P}$$

It is possible to express the angular speed vector in the reference system of the weapon ΣBODY by means of the rotation matrixes:

$$W_{BHB}=M_{NED_BODY}\cdot\begin{bmatrix}0\\0\\\dot{H}\end{bmatrix}_{\Sigma_{NED}}+M_{H_BODY}\cdot\begin{bmatrix}0\\\dot{P}\\0\end{bmatrix}_{\Sigma_H}+M_{P_BODY}\cdot\begin{bmatrix}\dot{R}\\0\\0\end{bmatrix}_{\Sigma_P}$$

$$\begin{aligned}M_{NED_BODY}&=M_{P_BODY}\cdot M_{H_P}\cdot M_{NED_H}=\\&=\begin{bmatrix}1&0&0\\0&\cos(R)&\sin(R)\\0&-\sin(R)&\cos(R)\end{bmatrix}\cdot\begin{bmatrix}\cos(P)&0&-\sin(P)\\0&1&0\\\sin(P)&0&\cos(P)\end{bmatrix}\cdot\\&\begin{bmatrix}\cos(H)&\sin(H)&0\\-\sin(H)&\cos(H)&0\\0&0&1\end{bmatrix}=\\&=\begin{bmatrix}\cos(P)\cdot\cos(H)&\cos(P)\cdot\sin(H)&-\sin(P)\\\sin(R)\cdot\sin(P)\cdot\cos(H)-\cos(R)\cdot\sin(H)&\sin(R)\cdot\sin(P)\cdot\sin(H)+\cos(R)\cdot\cos(H)&\sin(R)\cdot\cos(P)\\\cos(R)\cdot\sin(P)\cdot\cos(H)+\sin(R)\cdot\sin(H)&\cos(R)\cdot\sin(P)\cdot\sin(H)-\sin(R)\cdot\cos(H)&\cos(R)\cdot\cos(P)\end{bmatrix}\end{aligned}$$

$$\begin{aligned}M_{H_BODY}&=M_{P_BODY}\cdot M_{H_P}\\&=\begin{bmatrix}1&0&0\\0&\cos(R)&\sin(R)\\0&-\sin(R)&\cos(R)\end{bmatrix}\cdot\begin{bmatrix}\cos(P)&0&-\sin(P)\\0&1&0\\\sin(P)&0&\cos(P)\end{bmatrix}=\\&=\begin{bmatrix}\cos(P)&0&-\sin(P)\\\sin(R)\cdot\sin(P)&\cos(R)&\sin(R)\cdot\cos(P)\\\cos(R)\cdot\sin(P)&-\sin(R)&\cos(R)\cdot\cos(P)\end{bmatrix}\end{aligned}$$

By replacing the expressions of the rotation matrixes just obtained, $W_{BHB}$ becomes:

$$W_{BHB} = \begin{bmatrix} -\sin(P)\cdot\dot{H}+\dot{R} \\ \cos(R)\cdot\dot{P}+\sin(R)\cdot\cos(P)\cdot\dot{H} \\ -\sin(R)\cdot\dot{P}+\cos(R)\cdot\cos(P)\cdot\dot{H} \end{bmatrix}_{\Sigma_{BODY}}$$

The components Gx, Gy and Gz of $W_{BHB}$ are the components of the angular speed measured with a gyroscope having three axes, oriented with its axes parallel to the axes of the BODY reference system associated with the weapon.

To obtain the Pitch, Roll and Heading attitude angles of the weapon starting with the components Gx, Gy and Gz of the angular speed measured by the gyroscope integral with the weapon, the relations just obtained are inverted and integrated, i.e., to express $\dot{H}$, $\dot{P}$ and $\dot{R}$ according to the components of $W_{BHB}$ which are the magnitudes measured.

Thus, the following matrix relations are valid:

$$W_{BHB} = \begin{bmatrix} G_X \\ G_Y \\ G_Z \end{bmatrix} = \begin{bmatrix} -\sin(P)\cdot\dot{H}+\dot{R} \\ \cos(R)\cdot\dot{P}+\sin(R)\cdot\cos(P)\cdot\dot{H} \\ -\sin(R)\cdot\dot{P}+\cos(R)\cdot\cos(P)\cdot\dot{H} \end{bmatrix}$$

$$\begin{bmatrix} G_X \\ G_Y \\ G_Z \end{bmatrix} = \begin{bmatrix} 1 & 0 & -\sin(P) \\ 0 & \cos(R) & \sin(R)\cdot\cos(P) \\ 0 & -\sin(R) & \sin(R)\cdot\cos(P) \end{bmatrix}\cdot\begin{bmatrix} \dot{R} \\ \dot{P} \\ \dot{H} \end{bmatrix} = A\cdot\begin{bmatrix} \dot{R} \\ \dot{P} \\ \dot{H} \end{bmatrix}$$

Solving the system of equations, the following is obtained:

$det(A)=\cos(P)$;

in particular:

$$\dot{R} = \frac{\det\left(\begin{bmatrix} G_X & 0 & -\sin(P) \\ G_Y & \cos(R) & \sin(R)\cdot\cos(P) \\ G_Z & -\sin(R) & \cos(R)\cdot\cos(P) \end{bmatrix}\right)}{\cos(P)} = G_X + G_Y\cdot\sin(R)\cdot\tan(P) + G_Z\cdot\cos(R)\cdot\tan(P)$$

-continued $$\dot{P} = \frac{\det\left(\begin{bmatrix} 1 & G_X & -\sin(P) \\ 0 & G_Y & \sin(R)\cdot\cos(P) \\ 0 & G_Z & \cos(R)\cdot\cos(P) \end{bmatrix}\right)}{\cos(P)} = G_Y\cdot\cos(R) - G_Z\cdot\sin(R)$$

$$\dot{H} = \frac{\det\left(\begin{bmatrix} 1 & 0 & G_X \\ 0 & \cos(R) & G_Y \\ 0 & -\sin(R) & G_Z \end{bmatrix}\right)}{\cos(P)} = G_Y\cdot\frac{\sin(R)}{\cos(P)} + G_Z\cdot\frac{\cos(R)}{\cos(P)}$$

From what obtained above, it is possible to use a more compact relation, thus obtaining the following system which describes the relations B), D) and H):

$$\begin{cases} \begin{bmatrix} \dot{R} \\ \dot{P} \\ \dot{H} \end{bmatrix} = \begin{bmatrix} 1 & \sin(R)\cdot\tan(P) & \cos(R)\cdot\tan(P) \\ 0 & \cos & -\sin(R) \\ 0 & \frac{\sin(R)}{\cos(P)} & \frac{\cos(R)}{\cos(P)} \end{bmatrix}\cdot\begin{bmatrix} G_X \\ G_Y \\ G_Z \end{bmatrix} \\ \begin{bmatrix} R \\ P \\ H \end{bmatrix} = \int\begin{bmatrix} \dot{R} \\ \dot{P} \\ \dot{H} \end{bmatrix} + \begin{bmatrix} R(0) \\ P(0) \\ H(0) \end{bmatrix} \end{cases}$$

However, with regards to the relations A) and C), the following considerations are valid instead.

By assuming the positioning of three accelerometers with the measuring axes parallel to those of the BODY reference system $Z_{BODY}$ integral with the weapons, they measure the three components $A_x$, $A_y$ and $A_z$ of the acceleration.

Under the static condition, the three accelerometers measure the components of the acceleration of gravity in the BODY reference system $\Sigma_{BODY}$, hence the following is obtained:

$$AG_{NHN} = \begin{bmatrix} 0 \\ 0 \\ -g \end{bmatrix}_{\Sigma_{NED}}$$

$$AG_{NHB} = M_{NED_BODY}\cdot\begin{bmatrix} 0 \\ 0 \\ -g \end{bmatrix}_{\Sigma_{NED}} =$$

$$= \begin{bmatrix} \cos(P)\cdot\cos(H) & \cos(P)\cdot\sin(H) & -\sin(P) \\ \sin(R)\cdot\sin(P)\cdot\cos(H)-\cos(R)\cdot\sin(H) & \sin(R)\cdot\sin(P)\cdot\sin(H)+\cos(R)\cdot\cos(H) & \sin(R)\cdot\cos(P) \\ \cos(R)\cdot\sin(P)\cdot\cos(H)+\sin(R)\cdot\sin(H) & \cos(R)\cdot\sin(P)\cdot\sin(H)-\sin(R)\cdot\cos(H) & \cos(R)\cdot\cos(P) \end{bmatrix}\cdot$$

$$\begin{bmatrix} 0 \\ 0 \\ -g \end{bmatrix}_{\Sigma_{NED}}$$

$$= \begin{bmatrix} \sin(P)\cdot g \\ -\sin(R)\cdot\cos(P)\cdot g \\ -\cos(R)\cdot\cos(P)\cdot g \end{bmatrix}_{\Sigma_{BODY}}$$

$$AG_{NHB} = \begin{bmatrix} A_X \\ A_Y \\ A_Z \end{bmatrix}_{\Sigma_{BODY}} = \begin{bmatrix} \sin(P)\cdot g \\ -\sin(R)\cdot\cos(P)\cdot g \\ -\cos(R)\cdot\cos(P)\cdot g \end{bmatrix}_{\Sigma_{BODY}}$$

Hence it is possible to obtain the Pitch and Roll attitude angles from the expression $AG_{NHN}$ only under static conditions as when non-null dynamics of the weapon exist, and the accelerometers also measure the linear accelerations of the weapon itself in addition to the component of the acceleration of gravity. To resolve this drawback, the above-described electronic apparatus 1 provides to employ a low-pass filter in such a way to eliminate from the signal the contribution of any linear accelerations of the weapon.

From the above description, it is suitable to point out that the initial attitude of the weapon under the static condition is not apparently obtainable based on the mere integration of the speeds measured by the gyroscopes.

Apparatus 1 indeed allows to employ the acceleration measured by the accelerometers to compensate the intrinsic error in the speed measured by the gyroscope. Indeed, it is known that the speed signal provided by an electronic gyroscope is affected by drift/noise/disturbance, which introduces an error in the measuring. Accordingly, computing the attitude through a repeated operation of integration of the measured speed is affected by a consequential and repeated integration of the intrinsic disturbance in the speed signal, which thus determines an error in the final attitude.

According to a possible embodiment shown in the example in FIG. 1, the above-described electronic apparatus 1 may include a closed boxed frame 50, inside of which the inertial platform 6 and the processing unit 10 are arranged, and a coupling mechanism 51 adapted to allow to couple, stably but easily removable, the frame to weapon 2, in particular to the grenade launcher.

The above-described electronic apparatus provides an accurate indication of the attitude of the weapon, as the error introduced by the gyroscopes in speed measuring is reduced or eliminated due to the compensation obtained through the acceleration components provided by the accelerometers.

Moreover, the electronic apparatus is provided with an electronic architecture, which, in addition to being simple and affordable to make, has a very contained weight and volume.

Lastly, it is clear that modifications and variants may be made to the electronic apparatus and to the operating method without departing from the scope of the present disclosure.

From the foregoing it will be appreciated that, although specific embodiments have been described herein for purposes of illustration, various modifications may be made without deviating from the spirit and scope of the disclosure. Furthermore, where an alternative is disclosed for a particular embodiment, this alternative may also apply to other embodiments even if not specifically stated.

The invention claimed is:

1. An apparatus configured to determine the attitude angles of a weapon, comprising:

acceleration measuring means configured to measure the weapon acceleration components along axes of a first reference system integral with the weapon;

angular speed measuring means configured to measure weapon angular speed components along the axes of said reference system; and processing means configured to:

compute actual attitude angles of the weapon in dynamic conditions based on the weapon angular speed components;

determine static attitude angles of the weapon in static conditions of the weapon itself based on said weapon acceleration components, by filtering at a low frequency said weapon acceleration components;

correct said weapon angular speed components based on said static attitude angles and of said actual attitude angles;

determine a first static weapon attitude angle corresponding to a static pitch angle of the weapon based on a first component of the weapon acceleration along a first axis of said reference system at a computing time; said first axis being arranged coaxially to a longitudinal axis of a barrel of said weapon;

determine a second static attitude angle corresponding to a static roll angle of the weapon based on a second component of the weapon acceleration along a second axis of said reference system and said determined said static pitch at a computing time; said second axis being oriented towards the right side of a support frame of the weapon; and determine a third actual attitude angle corresponding to the actual heading angle of the weapon based on said weapon angular speed components, the actual roll and pitch angles determined a computing time preceding the current computing time;

receive, at a computing time, the actual attitude angles comprising the pitch, the roll, and the heading determined at a computing time preceding the current computing time;

determine a first correction factor of said angular seed components as a function of a difference between the static pitch and the dynamic pitch determined at the computing time preceding the current computing time; and determine a second correction factor of said angular speed components as a function of a difference between the static roll and the dynamic roll determined at the computing time preceding the current computing time.

2. The apparatus according to claim 1, wherein said processing means are configured to determine the first static weapon attitude angle corresponding to the static pitch ($Psc(t_i)$) by implementing the following mathematical relation: $Psc(t_i)=\arcsin(Ax(t_i))$;

wherein Ax(ti) is a first component of the weapon acceleration along a first axis of said reference system at a computing time $t_i$.

3. The apparatus according to claim 1, wherein said processing means are configured to determine the second static attitude angle corresponding to the static roll ($Rso(t_i)$) by implementing the following mathematical relation: $Rso(t_i)=\arcsin(Ay(t_i))/\cos(Psc(t_i))$;

wherein Ay(ti) is a second component of the weapon acceleration along a second axis of said reference system.

4. The apparatus according to claim 1, wherein said electronic processing means are configured to:

determine a first correction factor computing the difference between said actual Pitch angle computed at the time preceding the current computing time, and the static pitch angle computed at the current computing time;

compute a pitch differential $dP(t_i)$ through the relation:

$$dP(t_i)=Gy(t_i)*\cos(Rro(t_{i-1})-Gz(t_i)*\sin(Rro(t_{i-1}));$$

compute a corrected pitch differential by subtracting said first correction factor from said pitch differential; and integrate said corrected pitch differential over time so as to determine the actual pitch angle.

5. The apparatus according to claim 1, wherein said electronic processing means are configured so as to:

determine a second correction factor computing the difference between said actual roll angle computed at the time preceding the current computing time, and said static roll angle computed at the current computing time;

compute the roll differential $dP(t_i)$ through the following relation:

$$dR(t_i)=Gx(t_i)+Gy(t_i)*\sin(Rro(t_{i-1})*\tan(Prc(t_i))+Gz(t_{i-1})*\cos(Rro(t_{i-1}))*\tan(Prc(t_{i-1}))$$

compute a corrected roll differential by subtracting the correction factor from the roll differential;

integrate the corrected roll differential to determine the actual Roll angle.

6. The apparatus according to claim 1 wherein said processing means are configured to:

compute a heading differential $dP(t_i)$ through the following mathematical relation:

$$dH(t_i)=H1+H2;\text{ wherein}$$

$$H1=Gy(ti)*\sin(Rro(t_{i-1}))/\cos(Prc(t_{i-1}));$$

$$H2=Gz*\cos(Rro(t_{i-1})/\cos(Prc(t_{i-1});\text{ and}$$

integrate the heading differential over time to determine the actual heading angle.

7. A method for determining the attitude angles of a weapon, comprising:

measuring components of acceleration of the weapon along axes of a first reference system integral with the weapon;

measuring components of angular speed of the weapon along the axes of said reference system; and computing actual attitude angles of the weapon in dynamic conditions based on the components of the angular speed;

determining static attitude angles of the weapon in static conditions of the weapon based on said components of the acceleration, by filtering at a low frequency said acceleration components;

correcting said angular speed components based on of said static attitude angles and said actual attitude angles;

determining a first static weapon attitude angle corresponding to the static pitch angle of the weapon based on a first component of the weapon acceleration along a first axis of said reference system at a computing time; said first axis being arranged coaxially to a longitudinal axis of a barrel of said weapon;

determining a second static attitude angle corresponding to the static roll angle of the weapon based on a second component of the weapon acceleration along a second axis of said reference system and said determined said static pitch angle at a computing time; said second axis being oriented towards a right side of a support frame of the weapon;

determining a third actual attitude angle corresponding to the actual heading angle of the weapon based on said weapon angular speed components, the actual roll and pitch angles determined a computing time preceding the current computing time;

receiving at a computing time, the actual attitude angles comprising the pitch, the roll and the heading determined at a computing time preceding the current computing time;

determining a first correction factor of said angular speed components as a function of a difference between the static pitch and the dynamic pitch determined at the computing time preceding the current computing time; and determining a second correction factor of said angular speed components as a function of a difference between the static roll and the dynamic roll determined at the computing time preceding the current computing time.

8. The method according to claim 7, further comprising the step of determining the first static attitude angle of the weapon corresponding to the static pitch $Psc(t_i)$ by implementing the following mathematical relation: $Psc(t_i)=\arcsin(Ax(t_i))$;

wherein Ax(ti) is a first component of the acceleration of the weapon along a first axis of said reference system at a computing time $t_i$.

9. The method according to claim 7, further comprising the step of determining the second static attitude angle corresponding to the static roll $Rso(t_i)$ by implementing the following mathematical relation:

$$Rso(t_i)=\arcsin(Ay(t_i))/\cos(Psc(t_i));$$

wherein Ay(ti) is a second component of the acceleration of the weapon along a second axis of said reference system.

10. The method according to claim 7, further comprising the step of:

determining a first correction factor by computing the difference between said actual pitch angle computed at the time preceding the current computing time, and the static pitch angle computed at the current computing time;

computing a pitch differential $dP(t_i)$ through the relation:

$$dP(t_i)=Gy(t_i)*\cos(Rro(t_{i-1}))-Gz(t_i)*\sin(Rro(t_{i-1}));$$

computing a corrected pitch differential by subtracting said first correction factor from said pitch differential; and integrating said corrected pitch differential over time so as to determine the actual pitch angle.

11. The method according to claim 10, further comprising the step of:

determining a second correction factor computing the difference between said actual roll angle computed at the time preceding the current computing time, and said static roll angle computed at the current computing time;

computing the roll differential $dR(t_i)$ through the following relation:

$$dR(t_i)=Gx(t_i)+Gy(t_i)*\sin(Rro(t_{i-1})*\tan(Prc(t_i))+Gz(t_{i-1})*\cos(Rro(t_{i-1}))*\tan(Prc(t_{i-1}))$$

computing a corrected roll differential by subtracting the correction factor from the Roll differential;

integrating the corrected roll differential to determine the actual Roll angle.

12. The method according to claim 7, further comprising the steps of:

computing a heading differential $dH(t_i)$ through the following mathematical relation:

$$dH(t_i)=H1+H2;\text{ wherein}$$

$$H1=Gy(ti)*\sin(Rro(t_{i-1}))/\cos(Prc(t_{i-1}));$$

$$H2=Gz*\cos(Rro(t_{i-1})/\cos(Prc(t_{i-1});\text{ and}$$

integrating the heading differential over time to determine the actual Heading angle.

13. A computer product loadable on a memory of a computer and configured to implement, when running, the method according to claim 7.

* * * * *

UNITED STATES PATENT AND TRADEMARK OFFICE

CERTIFICATE OF CORRECTION

PATENT NO. : 9,038,900 B2
APPLICATION NO. : 13/640840
DATED : May 26, 2015
INVENTOR(S) : Marco Galanti et al.

It is certified that error appears in the above-identified patent and that said Letters Patent is hereby corrected as shown below:

In the claims,

In Claim 1, Column 12, line 26 of the patent, the word “seed” should read --speed--

Signed and Sealed this
Twenty-third Day of February, 2016

Michelle K. Lee

Michelle K. Lee
*Director of the United States Patent and Trademark Office*